US005726891A

United States Patent [19]

Sisson et al.

[11] Patent Number: 5,726,891

[45] Date of Patent: Mar. 10, 1998

[54] SURGE DETECTION SYSTEM USING ENGINE SIGNATURE

[76] Inventors: Patterson B. Sisson, 29 Edward St., West Haven, Conn. 06516; James V. Petrizzi, 66 Hayes Rd., Tariffville, Conn. 06081

[21] Appl. No.: 187,661

[22] Filed: Jan. 26, 1994

[51] Int. Cl.[6] ..... G06G 7/70

[52] U.S. Cl. ..... 364/431.02; 364/431.01; 364/494; 364/551.01; 60/39.03; 60/39.281; 60/39.27; 73/117.3; 73/117.2; 415/17; 415/27

[58] Field of Search ..... 364/431.01, 431.02, 364/431.03, 551.01, 494; 60/39.091, 39.093, 39.281, 39.29, 39.03, 39.27, 39.02, 39.24; 73/117.2, 117.3, 117.4, 116, 115; 415/27, 17, 118, 48, 32, 39, 292; 123/339.12, 339.24, 492, 493, 682

[56] References Cited

U.S. PATENT DOCUMENTS

| | | | |
|---|---|---|---|
| 4,060,979 | 12/1977 | Elsaesser et al. | 60/39.03 |
| 4,060,980 | 12/1977 | Elsaesser et al. | 60/39.03 |
| 4,137,710 | 2/1979 | Preti et al. | 60/39.28 |
| 4,159,625 | 7/1979 | Kerr | 364/431.02 |
| 4,449,360 | 5/1984 | Evans | 364/431.02 |
| 4,594,051 | 6/1986 | Gaston | 364/431.02 |
| 4,618,856 | 10/1986 | Antonazzi | 364/431.02 |
| 5,012,637 | 5/1991 | Dubin et al. | 364/431.02 |
| 5,051,918 | 9/1991 | Parsons | 364/494 |

*Primary Examiner*—Kevin J. Teska
*Assistant Examiner*—Jacques Louis-Jacques

[57] ABSTRACT

A method of, and a system for, detecting an occurrence of a surge in a gas turbine engine. The method includes steps, executed during consecutively occurring time periods, of: obtaining filtered derivatives of first and second engine operating characteristics; comparing the filtered derivatives of the first and the second engine operating characteristics to first and second threshold values, respectively; and incrementing a count only if both of the filtered derivatives exceed their respective threshold values. Otherwise, a next step decrements the count if one or both of the filtered derivatives do not exceed their respective threshold values. The method further includes a step of indicating a surge condition only if the count is equal to a predetermined value that is greater than unity. In a presently preferred embodiment of this invention the engine is a turbofan engine, the first engine operating characteristic is fan speed, and the second engine operating characteristic is exhaust gas temperature.

21 Claims, 3 Drawing Sheets

10
48msec CLK
COUNTER
INC BY 1
DEC BY 1
MIN=0
MAX=5
RESET TO 0
40
SRGC
≥5
42
SRGCNT
SRGFLG
SRGREC
52
RESET
50
0.336 SEC TIMER
START
T.
RESET
41
OR
POWER UP
MAN→AUTO
INC
DEC
39
AND
38
44
LATCH
SET
RESET
46
0.240 SEC. TIMER
START
48
RESET
>40%NH
28
NHCK
16
x<y
x
y
NLDOTF
-2.0%/SEC
24
x>y
X
y
T5DOTF
50.0°F/SEC
SRGREC
14
0.0625 * NLDOT (n)
+0.0625* NLDOT(n-1)
+0.8749 * NLDP
NLDOT
NLDP
F.
T.
18
SRGCLR
22
0.0625 * T5DOT (n)
+0.0625* T5DOT(n-1)
+0.8749 * T5DP
T5DOT
T5DP
F.
T.
26
SRGCLR
AND
32
Z-1
34
12
S
NLCK
20
S
T5CK
Z-1
30
SRGREC

SURGE DETECTION SYSTEM USING ENGINE SIGNATURE

FIELD OF THE INVENTION

This invention pertains to methods and apparatus for detecting a surge condition during the operation of a gas turbine engine.

BACKGROUND OF THE INVENTION

Various techniques have been developed for sensing the occurrence of a stall condition in a gas turbine engine. In general, a mild stall is indicated by one or more of the following: abnormal engine noise, rapid exhaust gas temperature fluctuations, RPM fluctuations, engine pressure ratio decrease or fluctuation, vibration due to compressor pulsations, and poor engine response to power level movements. A severe stall can be indicated by loud engine noises, flame, vapor, or smoke at the engine inlet and/or exhaust, and may be accompanied by engine malfunction or failure (see, for example, "Aircraft Gas Turbine Engine Technology", 2nd Edition, 1979, I.E. Treager, Mcgraw-Hill, Inc., pgs. 123–126).

Previous techniques that are known to the inventors for detecting an engine surge, which is often a precursor to a stall, include the following.

A first technique compares engine control parameters with actual engine parameters. By example, the existence of a sustained difference between a rate of change in engine speed, that is demanded by an engine control, and the actual rate of change in engine speed may indicate a surge condition.

Another technique uses an engine signature to detect an engine surge, and relies primarily on a measurement of combustor burner pressure. In particular, this technique relies on sensing a transient spike in the combustor burner pressure.

A third, and generally more complex, technique employs a large number of engine and airframe parameters which are individually weighted and compensated.

An example of this third technique is disclosed in U.S. Pat. No. 5,051,918, "Gas Turbine Stall/Surge Identification and Recovery", issued Sep. 24, 1991 to D. A Parsons. In this approach, applied to a turbine shaft (turboshaft) engine, a derivative of a shaft speed signal (NG) and a derivative of a measured gas temperature (MGT) signal are obtained, in conjunction with other gas turbine engine parameters, and are applied to a threshold logic circuit for comparison to corresponding threshold signals for determination of an incipient compressor stall condition. The MGT derivative circuit can include a low pass filter for noise suppression. A counter is incremented upon each exceedence of the threshold logic input signals over the corresponding threshold signals. The output of the counter is used as a bias signal to gain modify an acceleration schedule output, or can be used to trigger a visual/audio indication of stall incipiency to the pilot.

U.S. Pat. No. 4,060,979, "Stall Warning Detector for Gas Turbine Engine", issued Dec. 6, 1977 to F. I. Elsaesser et al., discloses the monitoring of turbine temperature in conjunction with either compressor speed or bleed valve position. In one case a stall signal is generated by an "AND" gate when the turbine temperature exceeds a predetermined value, and when the compressor speed decreases at a predetermined rate.

U.S. Pat. No. 4,060,980, "Stall Detector for a Gas Turbine Engine", also issued Dec. 6, 1977 to F. I. Elsaesser et al., discloses monitoring a minimum fuel flow schedule and another parameter (such as turbine inlet or exit temperature). In one case a stall signal is generated with an "AND" gate when a minimum fuel flow exists, and when the turbine temperature exceeds a predetermined level.

One problem that exists with conventional techniques is a susceptibility to "false alarms" generated by transient conditions. Another problem, especially apparent in the technique that relies on sensing a transient spike in the combustor burner pressure, is in the difficulty in sensing the spike and in differentiating same from normal combustor operation during surge-free operation.

OBJECTS OF THE INVENTION

It is a first object of this invention to provide an improved technique for detecting a surge condition in a gas turbine engine.

A further object of this invention is to provide an improved technique for detecting a surge condition in a turbine fan engine.

Another object of this invention is to provide an improved technique for detecting a surge condition in a turbine fan engine, wherein the technique does not require that a transient spike in a combustor burner pressure be detected.

A related object of this invention is to provide an improved technique for detecting a surge condition in a turbine fan engine, wherein the technique does not require that a large number of engine and airframe parameters be sensed, compensated and weighted.

SUMMARY OF THE INVENTION

The foregoing and other problems are overcome and the objects of the invention are realized by a method of, and a system for, detecting an occurrence of a surge in a gas turbine engine. The method includes steps, executed during individual ones of a plurality of consecutively occurring time periods, of: (a) obtaining a derivative of a first engine operating characteristic; (b) obtaining a derivative of a second engine operating characteristic; (c) comparing the derivative of the first engine operating characteristic to a first threshold value; and (d) comparing the derivative of the second engine operating characteristic to a second threshold value. A next step (e) increments a count only if (i) the derivative of the first engine operating characteristic exceeds the first threshold value, and also if (ii) the derivative of the second engine operating characteristic exceeds the second threshold value. Otherwise, a next step (f) decrements the count if the derivative of the first engine operating characteristic does not exceed the first threshold value and/or if the derivative of the second engine operating characteristic does not exceed the second threshold value.

The method further includes a step of (g) indicating a surge condition only if the count is equal to a predetermined value that is greater than unity, for example five.

The first and second steps of obtaining each include a step of filtering the obtained derivative with first and second filters, respectively. As a result, the steps of comparing each compare the filtered derivative.

The step of indicating includes a step of setting a value of at least one first filter parameter to the first threshold value, and a step of setting a value of at least one second filter parameter to a value of the second threshold value. As a result, after a surge is indicated the filters are reinitialized to a state that disregards the engine conditions that resulted in the indicated surge.

The method further includes the steps, performed during individual ones of the plurality of time periods, of setting a value of the at least one first filter parameter to the value of the filtered derivative of the first engine operating characteristic, and a step of setting a value of the at least one second filter parameter to the value of the filtered derivative of the second engine operating characteristic. As a result, the filters are updated and track the performance of the engine. Preferably, these filter parameters are employed to most heavily weight the filter output.

In a presently preferred embodiment of this invention the engine is a turbofan engine, the first engine operating characteristic is fan speed, and the second engine operating characteristic is exhaust gas temperature.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Of particular interest herein is the detection of an engine surge in a turbine fan (turbofan) engine, as opposed to a turbine prop (turboprop) or a turboshaft engine. One characteristic that distinguishes a turbine fan engine from the turbine prop and turbine shaft engines is the fixed geometry of the fan blades, as opposed to the variable pitch achievable with other types of engines. The inventors have realized that the fixed geometry of the fan blades enables the derivative of the fan speed to be employed, in conjunction with the derivative of the exhaust gas temperature, to detect the occurrence of an engine surge condition.

Figure 1:
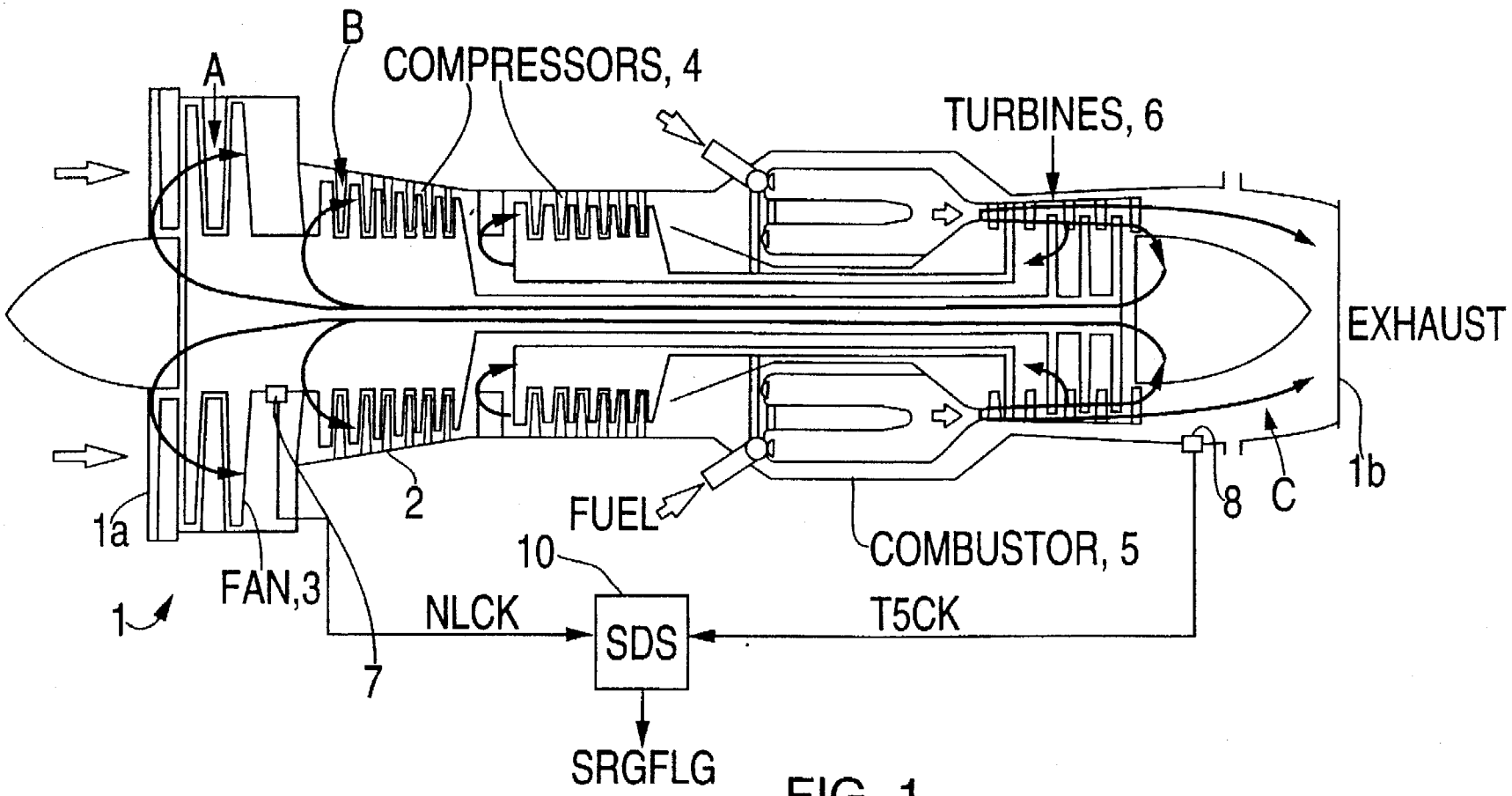
FIG. 1 is a simplified cross-sectional view of a turbine fan engine that includes the surge detection system of this invention.

FIG. 1 illustrates a simplified cross-sectional view of a conventional turbofan engine 1. The engine 1 has an air inlet 1*a* and an exhaust gas outlet 1*b*. The engine 1 is comprised of a housing 2, fan 3, compressors 4, combustors 5, and turbines 6. The arrows generally indicate the energy distribution, and in particular show the fan energy (A), compressor energy (B), and jet energy (C).

The teaching of this invention may be employed with a number of different types of turbofan engines. One suitable type is a LF507 turbine fan engine that is manufactured by Textron Lycoming.

This invention employs two engine operating characteristics, as represented by their respective electrical signals that are input to a novel surge detection system (SDS) 10. These two signals are a fan speed signal (NLCK), derived from a suitable fan speed transducer 7, and an exhaust gas temperature signal (T5CK) that is derived from a suitable temperature transducer 8. The output of the SDS 10 is a surge flag (SRGFLG) signal. The SRGFLG signal is preferably employed by a fuel control system (not shown) to vary the fuel flow to the combustors 5 in response to a detected surge. The SRGFLG signal may also be employed as an input to a suitable control system for varying some other engine parameter so as to avoid the occurrence of, or recover from, an engine stall. Of course, the SRGFLG signal may also be employed to provide an audio and/or visual surge indicator to a pilot.

As employed herein an engine surge is considered to be a sustained decrease in a rate of change of fan speed, in conjunction with an increase in a rate of change of engine exhaust temperature. The occurrence of a surge is indicative of an engine stall condition.

Figure 2:
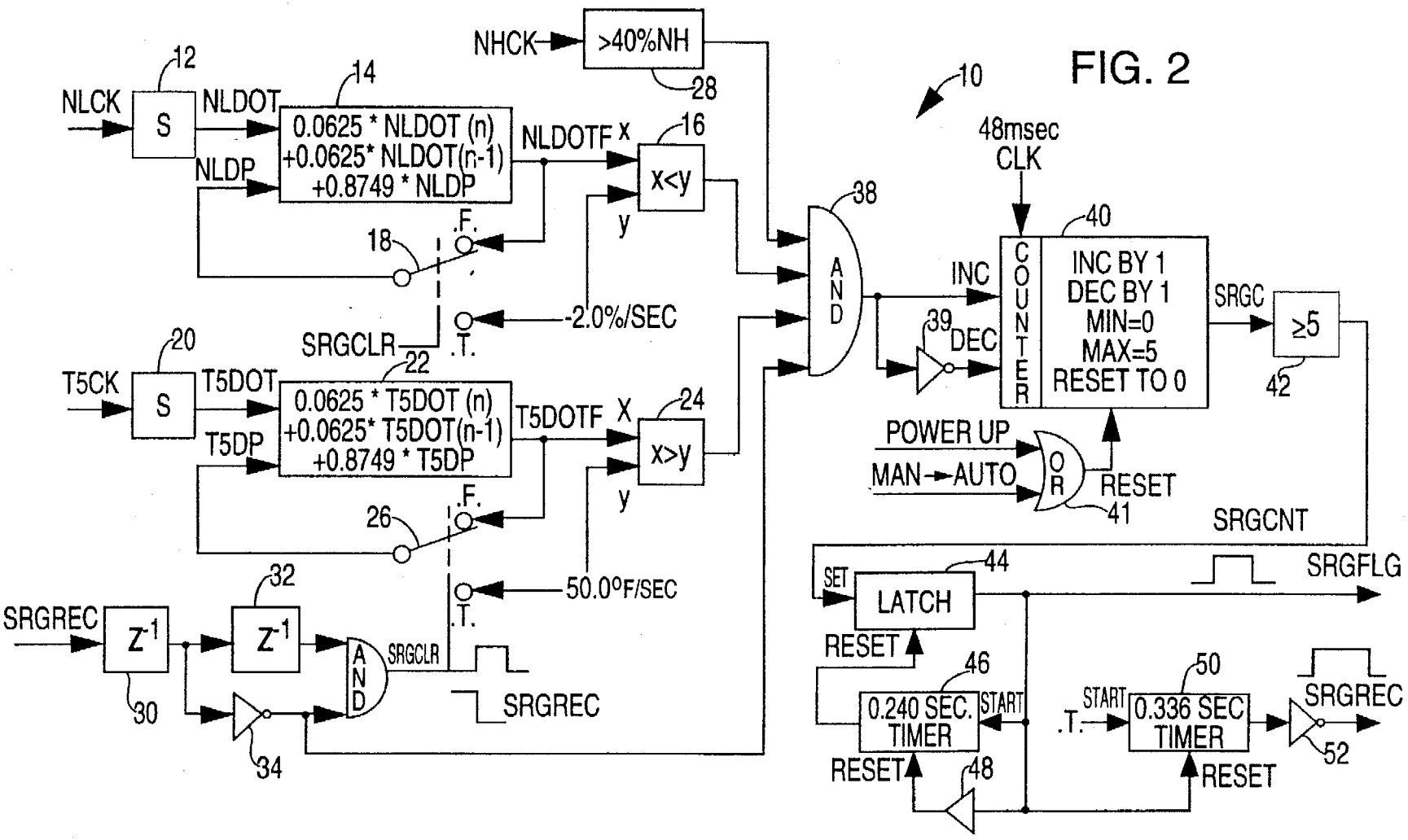
FIG. 2 is block diagram of the surge detection system that is constructed and operated in accordance with this invention.

Reference is now made to FIG. 2 for showing a block diagram of the surge detection system 10 that is constructed and operated in accordance with this invention. Although the surge detection system 10 is illustrated and described in the context of functional blocks, logic elements, and discrete circuits (such as switches), it should be realized that all or a part of these functions can be accomplished by a suitably programmed data or signal processor.

The fan speed signal NLCK is applied to a derivative calculation block (S) 12 which produces a fan speed derivative signal NLDOT once every 48 milliseconds (1 control cycle). The NLDOT signal is applied to a lowpass Butterworth filter 14 to remove high frequency noise. The filtered fan speed derivative signal (NLDOTF) is applied to an x input of a comparator 16. A predetermined threshold signal (−2.0%/sec) is applied to the y input of the comparator 16. The comparator 16 produces a true output when the filtered fan speed derivative signal is less than −2% per second.

The filtered fan speed derivative signal (NLDOTF) is also fed back through a (.F.) pole of a switch 18, during normal operation, to update a filter parameter NLDP. The filter 14 coefficients:

$$(0.0625 \cdot NLDOT\ (n)+0.0625 \cdot NLDOT(n-1)+0.8749 \cdot NLDP),$$

where (n) denotes data from the current 48 millisecond control cycle and (n−1) denotes data from the previous 48 millisecond control cycle, ensure that the most weight is placed on the most recent filter output (NLDP). In a preferred embodiment of this invention the resolution of NLDOTF and NLDP is 1/16 of the resolution of NLDOT, where "resolution" is intended to mean a minimum value by which a variable can be incremented or decremented.

In accordance with an aspect of this invention, the switch 18 is momentarily switched to the .T. pole position during an assertion of a surge clear (SRGCLR) signal. This resets the NLDP filter parameter to the predetermined threshold signal (−2%/sec), as will be described below.

The operation of the exhaust gas temperature processing circuitry mirrors that of the fan speed processing circuitry. More particularly, the exhaust gas temperature signal T5CK is applied to a derivative calculation block (S) 20 which produces an exhaust gas temperature derivative signal T5DOT once every 48 millisecond control cycle. The T5DOT signal is applied to a lowpass Butterworth filter 22 to remove high frequency noise. The filtered exhaust gas temperature derivative signal (T5DOTF) is applied to an x input of a comparator 24. A predetermined threshold signal (50° F./sec) is applied to the y input of the comparator 24. The comparator 24 produces a true output when the filtered exhaust gas temperature derivative signal is greater than 50° F./sec.

The filtered exhaust gas temperature derivative signal (T5DOTF) is fed back through the (.F.) pole of switch 26, during normal operation, to update a Butterworth filter parameter T5DP. As with the fan speed filter 14, the filter 22 coefficients:

$$(0.0625 \cdot T5DOT(n)+0.0625 \cdot T5DOT(n-1)+0.8749 \cdot T5DP)$$

where (n) denotes data from the current 48 millisecond control cycle and (n−1) denotes data from the previous 48 millisecond control cycle, ensure that the greatest weight is placed on the most recent filter output (T5DP). Furthermore, in the preferred embodiment of this invention the resolution of T5DOTF and T5DP is 1/16 of the resolution of T5DOT.

Further in accordance with an aspect of this invention, the switch 26 is also switched to the .T. pole position during the assertion of the surge clear (SRGCLR) signal. This resets the T5DP filter parameter to the predetermined threshold signal of 50° F./sec.

The block 28 generates an enabling output only when the speed of the turbine gas generator reaches 40% of its rated maximum speed. In that the gas generator ground idle speed is approximately 50% of maximum, the block 28 insures that the surge detection system 10 will operate only after the gas generator is out of the start region of operation.

Circuits 30, 32, 34 and 36 generate the surge clear (SRGCLR) signal for one control period (48 milliseconds) after a transition of a surge recovery (SRGREC) signal from true (asserted) to false (deasserted). Circuit elements 30 and 32 each function as a one control period delay element for the SRGREC signal, and the output of invertor 34 is low (false) only when the delayed SRGREC signal is high (true). The SRGREC signal is generated by the circuits 50 and 52, as described below, and is used to indicate that a surge recovery is underway.

The output of the comparators 16 and 24, and the circuits 28 and 34, are all applied to respective inputs of an AND gate 38. The output of the AND gate 38 is true only for the case where: (a) the gas generator speed is greater than 40% of its maximum speed; and (b) the delayed surge recovery (SRGREC) signal is not true; and (c) the filtered derivative of the fan speed signal is less than −2.0%/sec.; and (d) the filtered derivative of the exhaust gas temperature signal is greater than 50.0° F./sec. The presence of all four of these conditions, and in particular the simultaneous occurrence of the fan speed and exhaust gas temperature derivative signals each exceeding their thresholds, indicates a surge condition.

In order for a surge condition to be declared (the surge flag (SRGFLG) signal asserted), a counter 40 must increment to a count of 5. In this regard, the output of the AND gate 38 is applied to the active high increment input of the counter 40 and, through invertor 39, to the active high decrement input of the counter 40. The counter 40 receives a 48 millisecond control cycle clock signal (CLK), and either increments or decrements its count as a function of the logic state of the AND gate output. That is, when the output of the AND gate 38 is high the counter 40 increments, and when the output of the AND gate 38 is low the counter 40 decrements. The counter 40 is reset to zero through an OR gate 41 upon an occurrence of a power up signal, or upon an occurrence of a changeover from a backup hydromechanical control (manual mode) to the automatic mode of operation of the fuel control. The automatic mode employs the SDS 10 as described herein.

The output (SRGC) of the counter 40 is applied to a comparator 42. When the SRGC signal is equal to or greater than 5 a surge count (SRGCNT) signal is generated and is latched by latch 44. The output of the latch 44 going high initiates a 0.240 second timer 46, and also applies a reset to a 0.336 second timer 50. The reset to the timer 50 forces the output low and, through invertor 52, the SRGREC signal high (true). It is noted that the output of the timer 50 is initialized to true on power up.

The timer 46, in cooperation with invertor 48, sets the width of the SRGFLG signal at 0.240 seconds. After 0.240 seconds the reset is removed from the timer 50 and, 0.336 seconds later, the logic one (.T.) at the timer 50 input appears at the input to the invertor 52, thereby driving the SRGREC signal low (false). As a result, the duration of the SRGREC signal is established as 576 milliseconds (240+336). In this manner the surge recovery signal becomes true when the surge is detected and latched, and continues for 576 milliseconds thereafter.

It is noted that the assertion of the SRGREC signal for 576 milliseconds (12 control cycles) causes the output of AND gate 38 to be low for a corresponding length of time (via invertor 34) and, as a result, insures that the counter 40 decrements back to zero.

The actual mechanism for accomplishing surge recovery is not germane to an understanding of this invention, and is thus not described in detail except to indicate that, in a presently preferred embodiment of this invention, the SRGFLG and SRGREC signals are applied to surge recovery logic that is associated with the fuel control system.

As was described previously, the values for NLDP and T5DP of the Butterworth filters 14 and 22, respectively, are set equal to their respective thresholds upon completion of surge recovery, via the SRGCLR signal and switches 18 and 26. This resetting of the filter values, in accordance with an aspect of this invention, enables the SDS 10 to immediately begin surge detection without considering prior values of the engine parameters resulting from the previous surge condition.

In accordance with a further aspect of this invention, it is pointed out that the derivative circuits 12 and 20, and the filters 14 and 22, all remain operational when operating in the Manual mode. As a result, the parameters of filters 14 and 22 are updated and continue to track the operation of the engine fan speed and exhaust gas temperature such that, upon switching to the automatic mode (and initializing the counter 40 to zero), the SDS 10 is enabled to immediately begin monitoring the engine for the occurrence of a surge condition.

It should be noted that a minimum time to assert the SRGCNT signal (SRGC=5) starting from a counter reset is 5×48 milliseconds or 240 milliseconds. This implies that the output of the AND gate 38 remains true for five consecutive control cycles. However, the maximum time to assert the SRGCNT signal starting from a counter reset can be significantly longer than 240 milliseconds. For example, the following Table illustrates one possible sequence of events that culminate in the assertion of the SRGCNT signal, without causing an intervening reset of the counter 40.

TABLE

| # CONTROL CYCLES | AND 38 OUTPUT | FINAL SRGC VALUE |
|---|---|---|
| 4 | HIGH | 4 |
| 3 | LOW | 1 |
| 3 | HIGH | 4 |
| 2 | LOW | 2 |
| 1 | HIGH | 3 |
| 2 | LOW | 1 |
| 4 | HIGH | 5 (SRGFLG) |
| 12 | FORCED LOW BY SRGREC | 0 |

For this example a total of 19 control cycles (912 milliseconds) occur before the SRGFLG is asserted to indicate a surge condition. It can thus be seen that the SDS 10 maintains a historical record of the simultaneous occurrence of the derivative of the fan speed and exhaust gas temperature signals each exceeding their respective thresholds, and generates the surge flag in accordance with the maintained historical record. It can further be appreciated that this approach provides an immunity to transient conditions that would otherwise cause a surge to be declared.

Figure 3:
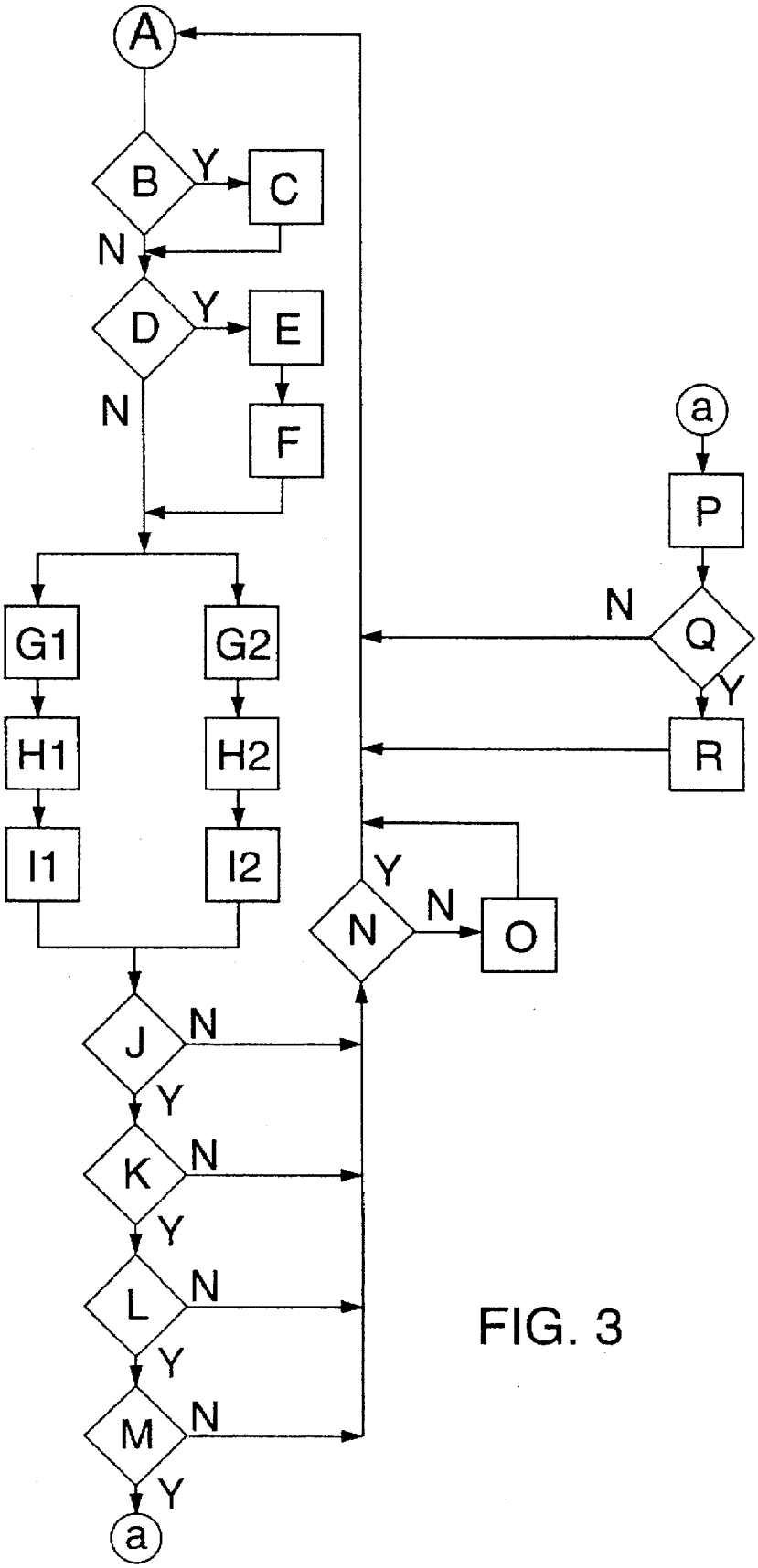
FIG. 3 is a logic flow diagram that illustrates the operation of the surge detection system of FIG. 2.

FIG. 3 is a logic flow diagram that illustrates the operation of the SDS 10 of FIG. 2 during one 48 millisecond control cycle. The alphabetically designated blocks function as follows.

A. The starting node from which the method begins once every control cycle.

B. A test is made to determine if the timer 46 (SRGFLG) has timed out.

C. If Yes, the SRGFLG signal is made false.

D. If No, or at the completion of the execution of block C, a test is made to determine if the timer 50 (SRGREC) has timed out.

E. If Yes, the SRGREC signal is made false.

F. Also if Yes, the SRGCLR signal is made true for one control cycle and the NLDP and T5DP filter parameters are updated from their respective threshold signals.

The operation of blocks G through I may occur in parallel to process the engine signals representing the fan speed and the exhaust gas temperature.

G1. The derivative NLDOT of NLCK is obtained.

H1. NLDOT is filtered to produce NLDOTF.

I1. NLDOTF is fed back as NLDP to the input of the filter 14.

G2. The derivative T5DOT of T5CK is obtained.

H2. T5DOT is filtered to produce T5DOTF.

I2. T5DOTF is fed back as T5DP to the input of the filter 22.

J. NLDOTF is input to comparator 16 to determine if NLDOTF is less than −2.0%/sec.

K. If Yes, T5DOTF is input to comparator 24 to determine if T5DOTF is greater than 50.0° F./sec.

L. If Yes, a determination is made by block 28 if NHCK is greater than 40% of NH.

M. If Yes, a determination is made if SRGREC is false.

If any of the tests in blocks J, K, L, or M indicate No, then block N is executed.

N. A determination is made if the counter 40 output (SRGC) equals 0.

O. If No, the counter 40 is decremented by 1.

If block N indicates Yes, or after decrementing the counter in block O, control passes to block A to await the beginning of the next control cycle.

For the case where the tests of blocks J, K, L, and M all indicate Yes, control passes to block P via the connector indicated by the lowercase "a".

P. Counter 40 is incremented by 1.

Q. A determination is made by comparator 42 if SRGC equals 5. If No, control passes to block A to await the beginning of the next control cycle.

R. If Yes, the timers 46 and 50 are both initiated to cause the SRGFLG and SRGREC signals to transition from false to true. Control then passes to block A to await the beginning of the next control cycle.

It can be appreciated that a number of the foregoing steps can be executed in other than the order indicated, while still achieving the same result.

The foregoing description has been made in the context of a presently preferred embodiment of the invention. It should, however, be realized that a number of modifications can be made to this presently preferred embodiment, and that such modifications will still fall within the teaching of this invention. For example, the duration of the control cycle, the various timer values, constant values, and threshold values can be made to differ from the explicit values given above. Thus, while the invention has been particularly shown and described with respect to a presently preferred embodiment thereof, it will be understood by those skilled in the art that changes in form and details may be made therein without departing from the scope and spirit of the invention.

What is claimed is:

1. A method of detecting an occurrence of a surge in a gas turbine engine, comprising the steps of:

during individual ones of a plurality of consecutively occurring time periods during an operation of a gas turbine engine, operating a first transducer to generate a first electrical signal for representing a first engine operating characteristic; processing the first electrical signal to obtain a derivative of the first engine operating characteristic;

operating a second transducer to generate a second electrical signal for representing a second engine operating characteristic;

processing the second electrical signal to obtain a derivative of the second engine operating characteristic;

comparing the derivative of the first engine operating characteristic to a first threshold value;

comparing the derivative of the second engine operating characteristic to a second threshold value;

incrementing a counter by a predetermined value only if the derivative of the first engine operating characteristic exceeds the first threshold value and if the derivative of the second engine operating characteristic exceeds the second threshold value; else, if at least one of the first and second threshold values is not exceeded, decrementing the counter by the predetermined value; and generating an output electrical signal for indicating an occurrence of a surge condition only if a value of the counter is equal to a predetermined value.

2. A method as claimed in claim 1, wherein each of the steps of processing includes a step of filtering the derivative that is obtained during the execution of the step, and wherein each of the steps of comparing compares the filtered derivative.

3. A method as claimed in claim 1, wherein the step of generating an output electrical signal includes a step of resetting the counter.

4. A method as claimed in claim 1, wherein: the step of processing the first electrical signal includes a step of filtering the obtained derivative of the first engine operating characteristic using a first filter having at least one first filter parameter;

the step of processing the second electrical signal includes a step of filtering the obtained derivative of the second engine operating characteristic using a second filter having at least one second filter parameter;

and wherein the step of generating an output electrical signal includes a step of setting a value of the at least one first filter parameter to the first threshold value, and a step of setting a value of the at least one second filter parameter the second threshold value.

5. A method as claimed in claim 1, wherein:

the step of processing the first electrical signal includes a step of filtering the obtained derivative of the first engine operating characteristic using a first filter having at least one first filter parameter;

the step of processing the second electrical signal includes a step of filtering the obtained derivative of the second engine operating characteristic using a second filter having at least one second filter parameter;

and wherein the method further includes the steps, performed during individual ones of the plurality of time periods, of setting a value of the at least one first filter parameter to the value of the filtered derivative of the first engine operating characteristic, and a step of setting a value of the at least one second filter parameter to the value of the filtered derivative of the second engine operating characteristic.

6. A method as claimed in claim 1, wherein the engine is a turbofan engine, wherein the first engine operating characteristic is fan speed, and wherein the second engine operating characteristic is exhaust gas temperature.

7. A system for detecting a surge in a gas turbine engine, comprising:

first means, having an input coupled to a first electrical signal and operating during individual ones of a plurality of consecutively occurring time periods, for determining a derivative of a first engine operating characteristic from the first electrical signal;

second means, having an input coupled to a second electrical signal and operating during individual ones of the plurality of consecutively occurring time periods, for determining a derivative of a second engine operating characteristic from the second electrical signal;

first means, having an input coupled to an output of said first determining means, for comparing the derivative of the first engine operating characteristic to a first threshold value;

second means, having an input coupled to an output of said second determining means, for comparing the derivative of the second engine operating characteristic to a second threshold value;

a counter including means, having inputs coupled to an output of each of said first and second comparing means, for incrementing a count of said counter only if said output of said first comparing means indicates that the derivative of the first engine operating characteristic exceeds the first threshold value and if said output of said second comparing means indicates that the derivative of the second engine operating characteristic exceeds the second threshold value;

said counter further including means for decrementing the count if at least one of said output of said first comparing means indicates that the derivative of the first engine operating characteristic does not exceed the first threshold value and if said output of said second comparing means indicates that the derivative of the second engine operating characteristic does not exceed the second threshold value; and means, having an input coupled to an output of said counter, for generating an output signal for indicating a surge condition in response to the count being equal to a predetermined value that is greater than unity.

8. A system as claimed in claim 7, and further comprising:

first filter means interposed between said output of said first determining means and said input of said first comparing means for filtering the derivative of the first engine operating characteristic; and second filter means interposed between said output of said second determining means and said input of said second comparing means for filtering the derivative of the second engine operating characteristic; wherein said first comparing means and said second comparing means both compare the filtered derivative of the associated engine operating characteristic to their respective threshold value.

9. A system as claimed in claim 8, wherein said first filter means operates in accordance with at least one first filter parameter; wherein said second filter means operates in accordance with at least one second filter parameter; and further comprising means, responsive to said indicating means indicating a surge condition, for setting a value of the at least one first filter parameter to the first threshold value and for setting a value of the at least one second filter parameter to a value of the second threshold value.

10. A system as claimed in claim 8, wherein said first filter means operates in accordance with at least one first filter parameter; wherein said second filter means operates in accordance with at least one second filter parameter; and further comprising:

means, coupled to an output of said first filter means, for setting a value of the at least one first filter parameter to the value of the filtered derivative of the first engine operating characteristic; and means, coupled to an output of said second filter means, for setting a value of the at least one second filter parameter to the value of the filtered derivative of the second engine operating characteristic.

11. A system as claimed in claim 7, and further comprising means, responsive to said indicating means indicating a surge condition, for resetting said counter.

12. A system as claimed in claim 7, wherein the engine is a turbofan engine, wherein the first engine operating characteristic is fan speed, and wherein the second engine operating characteristic is exhaust gas temperature.

13. A system for detecting a surge in a gas turbine fan engine having a rotating fan and a combustor generating an exhaust gas, comprising:

first means, having an input coupled to a first electrical signal and operating during individual ones of a plurality of consecutively occurring time periods, for determining a derivative of a speed of rotation of the fan from the first electrical signal;

second means, having an input coupled to a second electrical signal and operating during individual ones of the plurality of consecutively occurring time periods, for determining a derivative of a temperature of the exhaust gas from the second electrical signal;

first filter means having an input coupled to an output of said first determining means for filtering the derivative of the speed of rotation of the fan;

second filter means having an input coupled to an output of said second determining means for filtering the derivative of the temperature of the exhaust gas;

first comparing means having an input coupled to an output of said first filtering means for comparing the filtered derivative of the fan speed to a first threshold value;

second comparing means having an input coupled to an output of said second filtering means for comparing the derivative of the temperature of the exhaust gas to a second threshold value;

a counter including means, having inputs coupled to an output of each of said first and second comparing means, for incrementing a count of said counter only if said output of said first comparing means indicates that the filtered derivative of the fan speed exceeds the first threshold value and if said output of said second comparing means indicates that the filtered derivative of the temperature of the exhaust gas exceeds the second threshold value;

said counter further including means for decrementing the count if the count is not already zero and if at least one of said output of said first comparing means indicates that the filtered derivative of the fan speed does not exceed the first threshold value and if said output of said second comparing means indicates that the filtered derivative of the temperature of the exhaust gas does not exceed the second threshold value; and means, having an input coupled to an output of said counter, for generating an output signal for indicating a surge condition in response to the count being equal to a predetermined value that is greater than unity.

14. A system as claimed in claim 13, and further comprising means, responsive to said output signal of said indicating means indicating a surge condition, for resetting said counter.

15. A system as claimed in claim 13, wherein said first filter means operates in accordance with at least one first filter parameter; wherein said second filter means operates in accordance with at least one second filter parameter; and further comprising means, responsive to said output signal of said indicating means indicating a surge condition, for setting a value of the at least one first filter parameter to the first threshold value and for setting a value of the at least one second filter parameter to a value of the second threshold value.

16. A system as claimed in claim 13, wherein said first filter means operates in accordance with at least one first filter parameter; wherein said second filter means operates in accordance with at least one second filter parameter; and further comprising:

means, coupled to said output of said first filter means, for setting a value of the at least one first filter parameter to the value of the filtered derivative of the fan speed; and means, coupled to said output of said second filter means, for setting a value of the at least one second filter parameter to the value of the filtered derivative of the temperature of exhaust gas.

17. A system as claimed in claim 13, wherein said gas turbine fan engine further includes a gas generator, wherein said system further includes means for comparing an output of said gas generator for producing an enabling signal only upon a condition wherein the gas generator is operating above a predetermined speed, and wherein said incrementing means and said decrementing means are both coupled to and responsive to said enabling signal for operating only when said enabling signal is present.

18. A system as claimed in claim 13, wherein said indicating means includes means for generating a disabling signal at least while generating said output signal for indicating the surge condition, and wherein said incrementing means and said decrementing means are both coupled to and responsive to said disabling signal for operating only when said disabling signal is not generated.

19. A system as claimed in claim 13, wherein each of the plurality of consecutively occurring time periods has a duration of approximately 50 milliseconds, and wherein said means for indicating a surge condition is responsive to the count being equal to five.

20. A system as claimed in claim 13, wherein said first filter means operates in accordance with first filter parameters given by:

$$(x_1 \cdot NLDOT(n)+y_1 \cdot NLDOT(n-1)+z_1 \cdot NLDP),$$

where NLDOT is the derivative of fan speed and where NLDP is selected from one of the first threshold value and the value of the filtered derivative of the fan speed from a previous one of the consecutively occurring time periods; wherein said second filter means operates in accordance with second filter parameters given by:

$$(x_2 \cdot T5DOT(n)+y_2 \cdot T5DOT(n-1)+z_2 \cdot T5DP),$$

where T5DOT is the derivative of the exhaust gas temperature and where T5DP is selected from one of the second threshold value and the value of the filtered derivative of the exhaust gas temperature from the previous one of the consecutively occurring time periods, and wherein $x \ll z$ and $y \ll z$.

21. A method of operating a fuel control system for a gas turbine engine, comprising the steps of:

when operating in a manual mode of operation and, during individual ones of a plurality of consecutively occurring time periods, (a) obtaining a filtered derivative of a first engine operating characteristic;

(b) obtaining a filtered derivative of a second engine operating characteristic;

(c) comparing the filtered derivative of the first engine operating characteristic to a first threshold value;

(d) comparing the filtered derivative of the second engine operating characteristic to a second threshold value;

(e) incrementing a counter only if the filtered derivative of the first engine operating characteristic exceeds the first threshold value and if the filtered derivative of the second engine operating characteristic exceeds the second threshold value; else (f) decrementing the counter; and (g) periodically updating a value of filter parameters used in obtaining the filtered derivatives;

in response to an input electrical signal that indicates a change from the manual mode of operation to an automatic mode of operation, the method further includes the steps of:

resetting the counter;

continuing to execute steps (a) through (g) during individual ones of the plurality of consecutively occurring time periods, wherein initially the value of the filter parameters is a function of the engine operation during the manual mode of operation; and indicating an occurrence of an engine surge condition only if a value of the counter is equal to a predetermined value that is greater than unity.

* * * * *